US005712608A

United States Patent [19]

Shimomura et al.

[11] Patent Number: 5,712,608

[45] Date of Patent: Jan. 27, 1998

[54] MATRIX RELAY

[75] Inventors: Tsutomu Shimomura; Fumihiro Kasano, both of Osaka; Shiro Maeda, Mie; Masayuki Shiomi, Mie; Takao Morimoto, Mie; Tatsuya Suzuki, Mie; Hiroshi Hosaka, Tokyo, all of Japan

[73] Assignees: Masushita Electric Works, Ltd., Osaka; Nippon Telegraph and Telephone Corporation, Tokyo, both of Japan

[21] Appl. No.: 613,457

[22] Filed: Mar. 11, 1996

[30] Foreign Application Priority Data

Mar. 13, 1995 [JP] Japan ..... 7-052919

[51] Int. Cl.[6] ..... H01H 7/00

[52] U.S. Cl. ..... 335/60; 335/106

[58] Field of Search ..... 335/106–113, 60

[56] References Cited

U.S. PATENT DOCUMENTS

| | | | |
|---|---|---|---|
| 3,646,303 | 2/1972 | Warman | 335/108 |
| 3,845,430 | 10/1974 | Petkewicz et al. | 335/108 |
| 4,060,782 | 11/1977 | Inagawa et al. | 335/112 |

FOREIGN PATENT DOCUMENTS 4-58423 2/1992 Japan .

*Primary Examiner*—Lincoln Donovan

*Attorney, Agent, or Firm*—Armstrong, Westerman, Hattori, McLeland & Naughton

[57] ABSTRACT

A matrix relay is formed with a plurality of latching relays arranged in a matrix and mounted on a base of an electrically insulative material. Each of the latching relays comprises an excitation coil, permanent magnet, a pair of first and second fixed contacts, and an armature carrying a pair of first and second movable springs each providing movable contacts. The armature is magnetically coupled to the excitation coil so as to be movable in response to energization of the coil by current of selective polarity between close and open positions of the fixed and movable contacts. A plurality of the armatures of the latching relays arranged in a row of the matrix are assembled into a single armature block to be mounted on the base as a single unit. The armature block comprises a single pair of first and second supporting members made of an electrically conductive material. All of the first movable springs and all of the second movable springs of the latching relays of the armature block are connected respectively to the first and second supporting members mechanically and electrically, so that two row paths for electrical signals common to the latching relays arranged in the row of the matrix are provided. This simplification of the structure and electric circuit of the matrix relay would be useful to small-size the matrix relay without complicated fabrication process.

14 Claims, 11 Drawing Sheets

1
2
10
11
12
13
14
15
16
20
21
22
23
W

MATRIX RELAY

BACKGROUND ART

1. Field of the Invention

The present invention relates to a matrix relay which is formed with a plurality of latching relays mounted on a base and arranged in a matrix.

2. Disclosure of the Prior Art

In the past, a matrix relay as a switching unit in a telephone system has been proposed to comprise a plurality of latching relays mounted on a printed circuit board and arranged in a matrix pattern. The matrix relay is fabricated by assembling each of the latching relays with the use of parts of a base, armature having a movable contact, excitation coil, permanent magnet, magnet shunt, and a stationary contact, then incorporating the assembled latching relay in a relay case to obtain a relay block, and finally mounting the relay blocks on the printed circuit board in the matrix. Thus, complicated fabrication process, which is not suited for low cost fabrication, is required to fabricate the matrix relay.

To improve the above problem, a Japanese Patent Early Publication [KOKAI] No. 4-58423 proposes a collective relay which is formed with a plurality of latching relays mounted on a base and arranged in a matrix. Each of the latching relays comprises an electromagnet having an excitation coil and iron core, permanent magnet for providing a latching force, a pair of fixed contacts, and an armature unit carrying a pair of movable springs with movable contacts. The collective relay is characterized in that all of the fixed contacts of the latching relays arranged in the matrix are formed on a common substrate, and all of the iron cores of the latching relays arranged along a row of the matrix are formed as integral parts of a single yoke. Since the total number of parts for the matrix relay are reduced by the use of the common substrate and the single yoke, the complicated fabrication process of the matrix relay would be improved to some extent. However, the armature units of the latching relays have to be individually attached to the common substrate such that the movable springs are movable between close and open positions of the fixed and movable contacts. Thus, there is room for further search from the viewpoint of a simple and compact structure of the collective relay, while improving the complicated fabrication process.

SUMMARY OF THE INVENTION

The present invention is directed to a matrix relay to improve the above problem and insufficiently. The matrix relay is formed with a plurality of latching relays arranged in a matrix and mounted on a base of an electrically insulative material. Each of the latching relays comprises an excitation coil, permanent magnet for providing a latching force, a pair of first and second fixed contacts, and an armature carrying a pair of first and second movable springs. Each of the first and second movable springs has a movable contact. The armature is magnetically coupled to the excitation coil so as to be movable in response to energization of the excitation coil by current of selective polarity between close and open positions of the fixed and movable contacts. In the present invention, a plurality of the armatures of the latching relays arranged in a row of the matrix are assembled into a single armature block to be mounted on the base as a single unit. The armature block comprises a single pair of first and second supporting members made of an electrically conductive material. All the first movable springs and all the second movable springs of the armatures of the armature block are connected respectively to the first and second supporting members mechanically and electrically, so that two row paths for electrical signals common to the latching relays arranged in the row of the matrix are provided.

Since a plurality of the armatures can be mounted on the base as the single armature block, the complicated fabrication process of the matrix relay would be improved. In addition, the first and second supporting members of the armature block function as electrical conductors common to the armatures of the armature block to provide simple wiring among the latching relays arranged in the row of the matrix. Therefore, this simplification of electric circuits of the matrix relay would be specifically useful to small-size the matrix relay. As a result, the above features of the present matrix relay will make possible low cost fabrication of the small-sized matrix relay.

Therefore, it is a primary object of the present invention is to provide a matrix relay comprising a plurality of latching relays arranged in a matrix, and characterized by the use of an armature block in which two row paths for electrical signals common to the latching relays arranged in a row of the matrix are formed.

In a preferred embodiment of the invention, each of the latching relays includes a contact holder made of an electrically insulative material. The contact holder supports the first and second fixed contacts. A plurality of the contact holders of the latching relays arranged in a column of the matrix are assembled into a single contact block to be mounted on the base as a single unit. The contact block comprises a single pair of first and second lead members of an electrically conductive material. All the first fixed contacts and all the second fixed contacts of the contact holders of the contact block are connected respectively to the first and second lead members mechanically and electrically, so that two column paths for electrical signals common to the latching relays arranged in the column of the matrix are provided. Thus, further improvement of the complicate fabrication process and simplification of the electric circuits of the matrix relay can be achieved by the use of the contact block, which is therefore another object of the present invention.

In a further preferred embodiment of the invention, the excitation coil of each of the latching relays has first and second ends, and is fitted around a coil bobbin. The coil bobbin has a bore which receives one of cores projecting on the base and arranged in the matrix. The cores arranged along the row of the matrix are formed as integral parts of a single yoke which is molded into the base to project the cores on the base. Since the base is reinforced by embedding the yoke into the base, it is possible to prevent the occurrence of warp of the base.

In addition, it is preferred that all the first ends of the excitation coils of the latching relays arranged along the column of the matrix are connected electrically and mechanically to a common conductor so that the excitation coils arranged along the column are assembled into a single coil block to be mounted on the base as a single unit. Therefore, it is possible to avoid complicated fabrication step of wiring between adjacent excitation coils in the column after the coil block is mounted on the base.

In another preferred embodiment of the invention, the permanent magnets are mounted on the base in such an arrangement that a magnetic force of the permanent magnet of each of the latching relays are cooperative with that of adjacent latching relay in the row of the matrix to hold the armature in the close position. In particular, an additional permanent magnet is preferably mounted on the base outwardly of the outermost one of the latching relays arranged in the row of the matrix so as to be cooperative with the permanent magnet of the outermost latching relay to thereby give a magnetic force of holding the armature in the close position. As a result, the latching force with equal amplitude can be uniformly provided to the individual latching relays to achieve stable relay performance of the matrix relay.

It is also preferred that the first and second movable springs are supported to the first and second supporting members through joints in a cantilever fashion such that the first and second supporting members are electrically connected to the movable contacts on the first and second movable springs, respectively. More preferably, the joints are formed as integral parts of the first and second movable springs, respectively.

These and still other objects and advantages will become apparent from the following description of the preferred embodiment of the invention when taken in conjunction with the attached drawings.

DESCRIPTION OF THE PREFERRED EMBODIMENTS

Figures 1A, 1B, 1C:
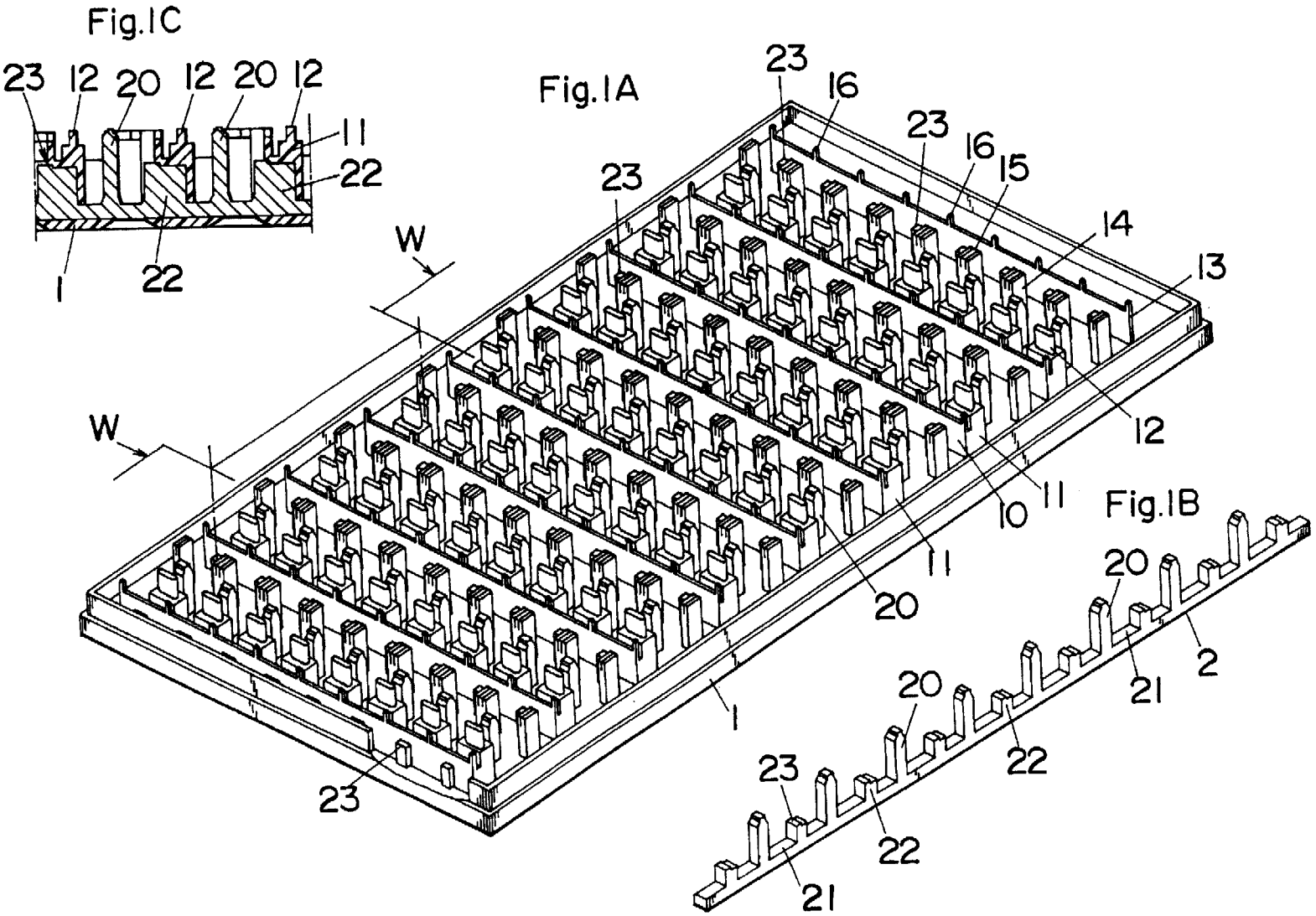
FIG. 1A is a perspective view of a base, on which iron cores are projected, of a matrix relay in accordance with an embodiment of the present invention.
FIG. 1B is a perspective view of a yoke having the iron cores to be embedded in the base.
FIG. 1C is a cross-sectional view taken along the line W—W in FIG. 1A.

Referring to the attached drawings, a matrix relay comprising sixty-four latching relays mounted on a base 1 and arranged in a matrix (8×8) is explained as an embodiment of the present invention. However, the number of the latching relays to be mounted on the base should not be limited to this embodiment. Each of the latching relays comprises an excitation coil 50, iron core 20, magnet shunt 30, permanent magnet 40, stationary contact holder 60, armature unit 70, and diode circuit 104.

Figure 4A:
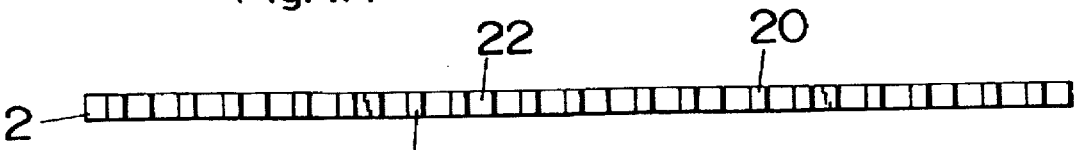
FIGS. 4A and 4B are top and front views of the yoke used in the matrix relay, respectively.
Figure 4B:
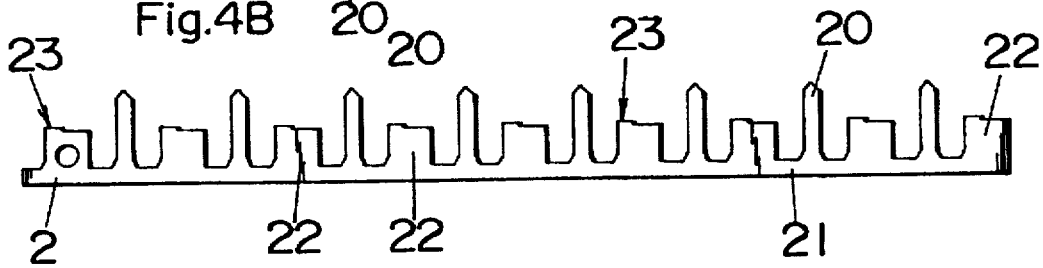

First, the base 1 of the matrix relay is explained in detail. As shown in FIG. 1A, the base 1 is made of an electrically insulative resin, and has a plurality of core blocks 2 embedded therein. As shown in FIGS. 1B, 4A and 4B, each of the core blocks 2 is made of a magnet material, and formed with a single yoke 21, the iron cores 20 and iron teeth 22 projected on the single yoke 21. The iron cores 20 are staggered with respect to the iron teeth 22 with a desired pitch between the adjacent iron cores. For example, the core block 2 may be produced by die-cut process. In this embodiment, eight core blocks 2 are arranged parallel to each other, and then molded with the insulating resin such that the yokes 21 are embedded in the base 1 and the iron cores 20 are vertically projected on the base, as shown in FIG. 1A. An axial direction of the yoke 21 embedded in the base 1 is defined as a row direction of the matrix relay in this embodiment.

The base 1 is molded to comprise a plurality of armature stands 14, partitions 10, and holder stands 11. Each of the armature stands 14 has two grooves 15 in its top face for supporting the armature unit 70 to the base 1. However, there is only one groove in each of two armature stands 14 which are located at the opposite ends of the armature stands arranged with a desired pitch in the column direction. A pair of the grooves 15 of the adjacent armature stands 14 in the column direction are used to support one armature unit 70. Each of the holder stands 11 has a projection 12 for fixing the contact holder 60 to a predetermined position on the base 1. Each of the partitions 10 extends along the column direction and is coupled with the holder stands 11 arranged in the column direction. The partition 10 has a plurality of guide pins 16 which are useful to attach the armature unit 70 accurately to a predetermined position on the base 1 cooperatively with the grooves 15 of the armature stands 14. As shown in FIG. 1C, each of the iron teeth 22 is partially embedded in the holder stand 11 on the base 1 such that a shoulder portion 23 of the iron tooth 22 is projected from the partition 10, as shown in FIGS. 1A and 1C. In FIG. 1A, a part of front wall of the base 1 is eliminated to illustrate the shoulder portion 23.

Figure 3:
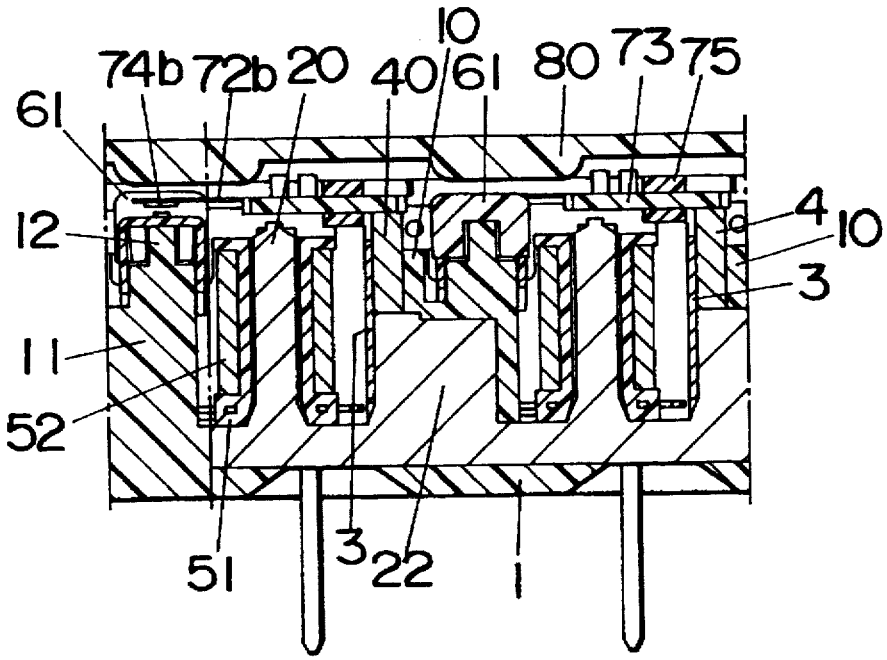
FIG. 3 a cross-sectional view of the latching relays taken along the line X—X in FIG. 2.
Figure 5A:
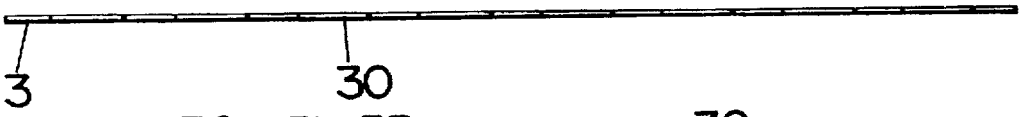
FIGS. 5A and 5B are top and front views of a shunt block used in the matrix relay, respectively.
Figure 5B:
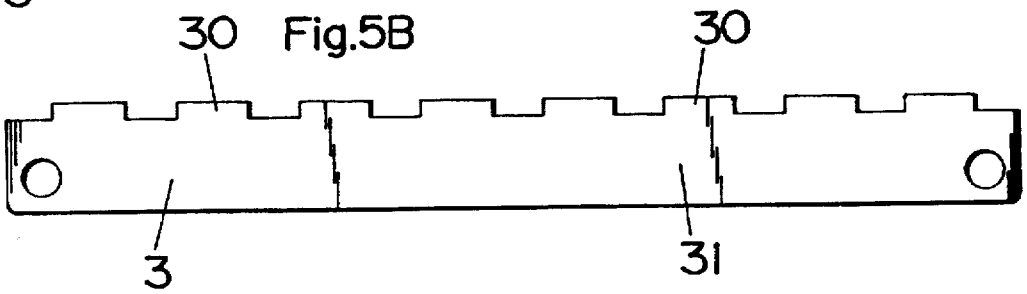
Figure 6A:
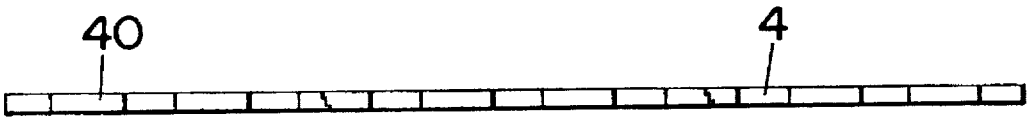
FIGS. 6A and 6B are top and front views of a magnet block used in the matrix relay, respectively.
Figure 6B:
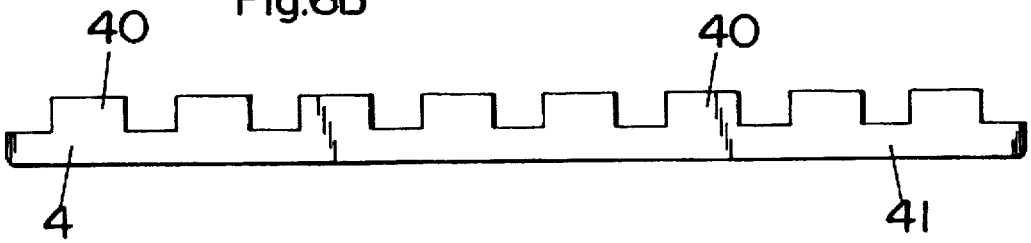

As shown in FIGS. 6A and 6B, a magnet block 4 is formed with a single frame 41 and a plurality of magnet teeth, each of which functions as the permanent magnet 40. The bottom face of the magnet block 4 is placed on the shoulder portions 23 projected from the partition 10 and arranged in the column direction such that the magnet block 4 contacts the partition 10, as shown in FIG. 3. In addition, a shunt block 3 is placed on the base 1 along the magnet block 4 such that the magnet block is sandwiched between the partition 10 and shunt block 3, as shown in FIG. 3. As shown in FIGS. 5A and 5B, the shunt block 3 is formed with an elongate strip 31 and a plurality of shunt teeth, each of which functions as the magnet shunt 30. An additional partition, which is designated by the numeral 13, is formed on the base 1 in parallel with the partition 10 and adjacent to a rear wall of the base. The shoulder portions 23 of the iron teeth 22 are projected from the additional partition 13. The magnet block 4 and the shunt block 3 are provided to the additional partition 13 as well as the partition 10.

Figure 8A:
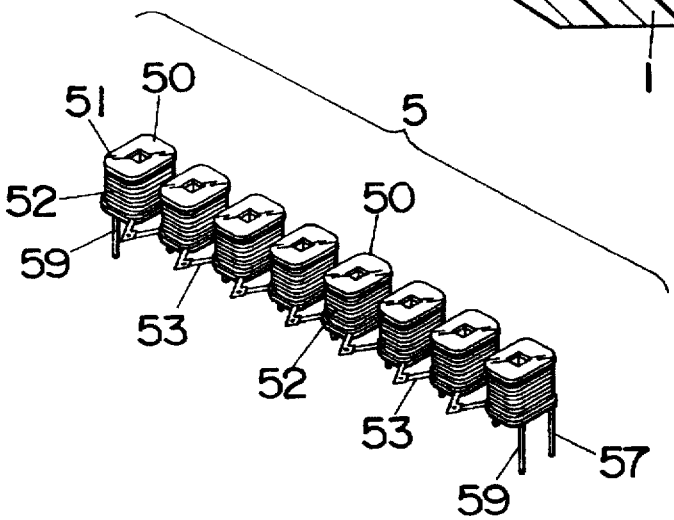
FIG. 8A is a perspective view of a coil block of the present matrix relay.
Figure 8B:
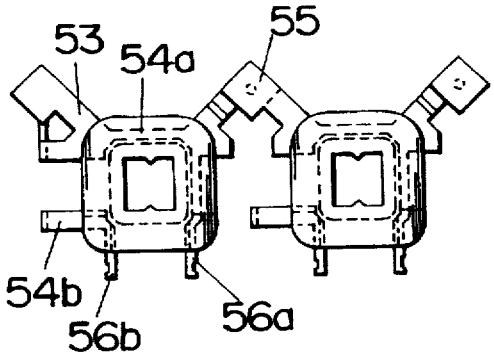
FIG. 8B is a top view of two excitation coils of the coil block.
Figure 8C:
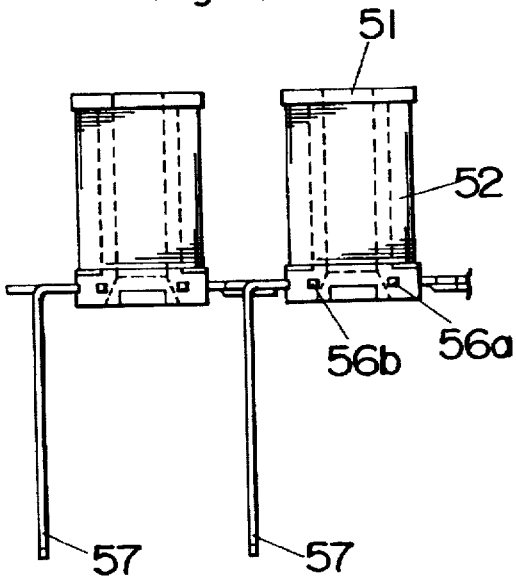
FIG. 8C is a side view of the two excitation coils of the coil block.

As shown in FIG. 8A, a plurality of the excitation coils 50 arranged in the column direction of the matrix is provided as a single coil block 5. Each of the excitation coils 50 is formed with a coil bobbin 51 made of an electrically insulating resin, and a number of turns of coil wire 52 wound around the bobbin. The coil bobbin 51 has a bore for receiving one of the iron cores 20 projecting on the base 1. The opposite ends of the coil wire 52 are respectively connected to first and second lead members 54*a* and 54*b*. The first lead member 54*a* has a pair of lead arms 53, and a first hook 56*a* to which one end of the coil wire 52 is connected. The second lead member 54*b* has a second coil terminal 57 extending downwardly from the bottom of the coil bobbin 51, as shown in FIG. 8C, and a second hook 56*b* to which the other end of the coil wire 52 is connected. These lead members 54*a* and 54*b* are partially embedded in the bottom of the coil bobbin 51 such that the lead arms 53, the first and second hooks 56*a* and 56*b* are projected horizontally from the coil bobbin 51, as shown in FIG. 8B. The lead arms 53 of the excitation coil 50 are respectively connected to the lead arms of adjacent excitation coils by spot welding 55 to provide the coil block 5, as shown in FIG. 8A.

Figure 11:
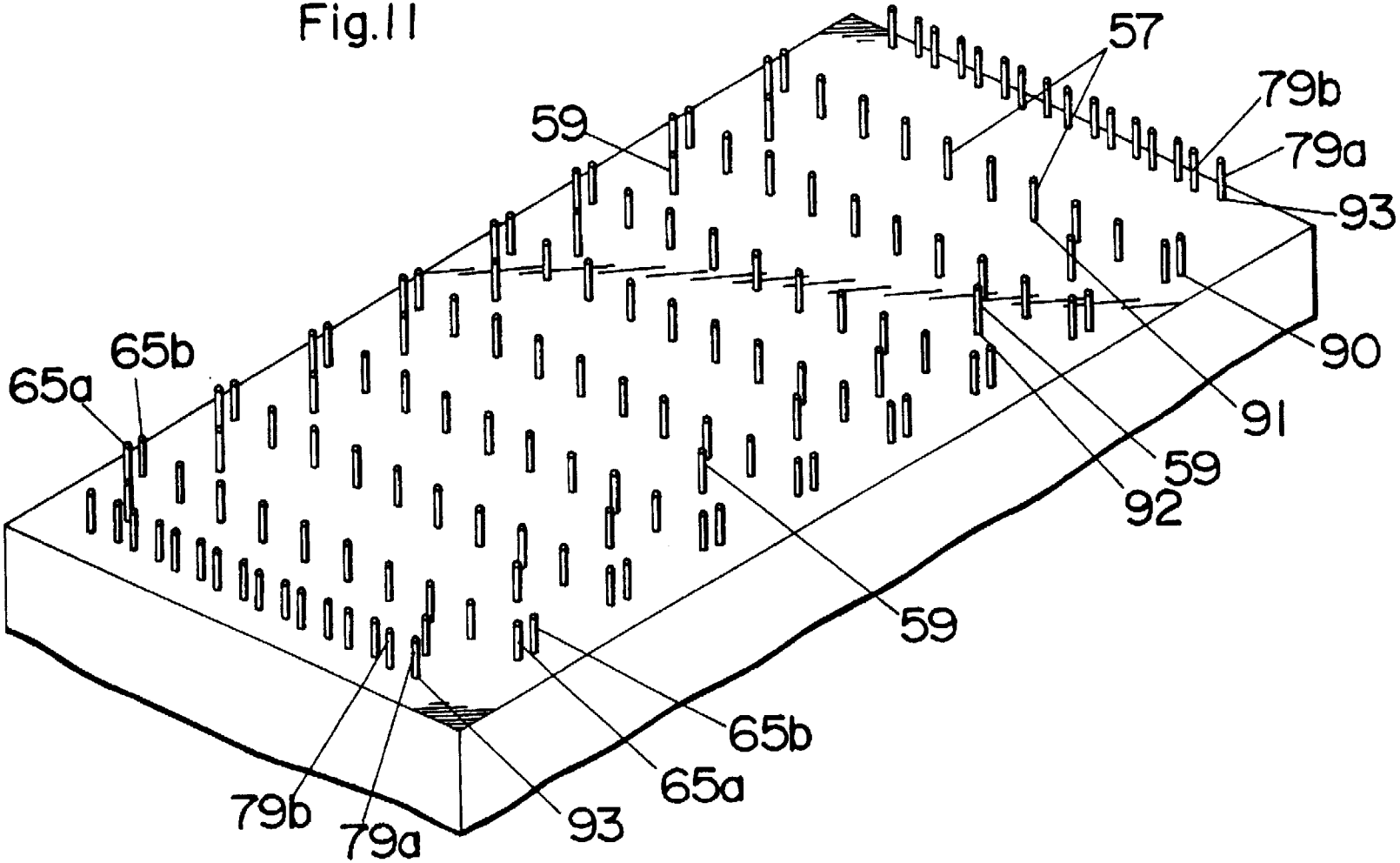
FIG. 11 is a perspective view of a rear face of the base of the matrix relay.

In FIG. 8A, unconnected lead arms of the excitation coils 50 located at the opposite ends of the coil block 5 are modified to provide a pair of first coil terminals 59 extending parallel to the second coil terminals 57 and downwardly from the bottom of the coil bobbin 51. Therefore, a current path common to the excitation coils 50 of the contact block 5 is formed between the first coil terminals 59. The coil block 5 is attached to the base 1 such that the iron cores 20 arranged on the base in the column direction are inserted into the bores of the excitation coils 50, and the first and second coil terminals 59 and 57 are projected from a rear face of the base through coil terminal holes 92 and 91, as shown in FIG. 11.

Figure 9A:
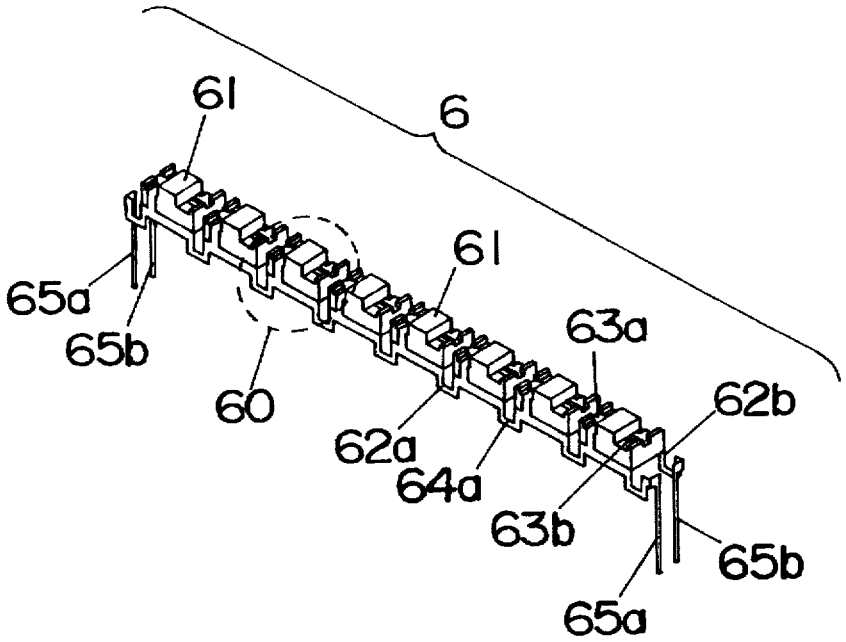
FIG. 9A is a perspective view of a contact block of the present matrix relay.
Figure 9B:
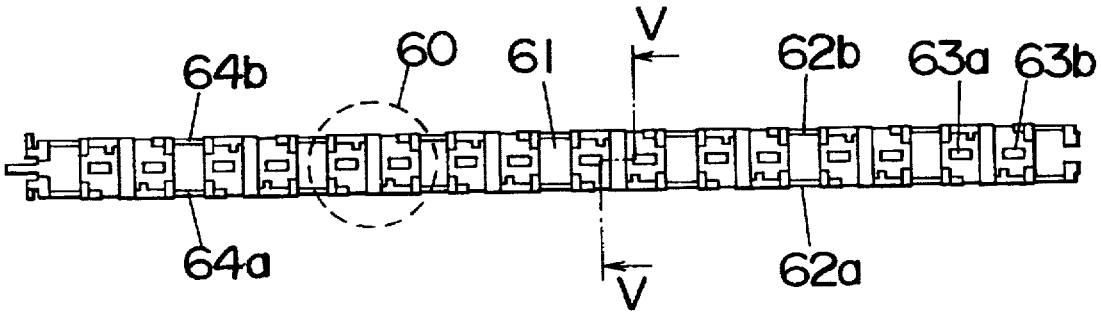
FIG. 9B is a top view of the contact block.

As shown in FIG. 9A, a plurality of the contact holders 60 arranged in the column direction of the matrix is provided as a single contact block 6. Each of the contact holders 60 is made of an electrically insulative material and support first and second stationary contacts 63*a* and 63*b*. The contact holder 60 also has a separation 61 projecting on its top face, which divides the top face of the contact holder into two sections for the first and second contacts 63*a* and 63*b*, as shown in FIG. 9B. The contact holders 60 arranged in the column of the matrix are mechanically linked only by a pair of first and second leads 62*a* and 62*b* made of an electrically conductive material, to thereby form the contact block 6. That is, all of the first stationary contacts 63*a* of the contact holders 60 of the contact block 6 are electrically connected to the first lead 62*a*. On the other hand, all of the second stationary contacts 63*b* of the contact holders 60 of the contact block 6 are electrically connected to the second lead 62*b*. Therefore, the first and second leads 62*a* and 62*b* provides two column paths for electrical signals common to the latching relays arranged in the column of the matrix. The opposite ends of the first lead 62*a* are bent substantially in a perpendicular direction to the bottom of the contact holder 60 to define stationary contact terminals 65*a* for one of the column paths. Similarly, the opposite ends of the second lead 62*b* are bent substantially in the perpendicular direction to define stationary contact terminals 65*b* for the other one of the column paths.

Figure 9C:
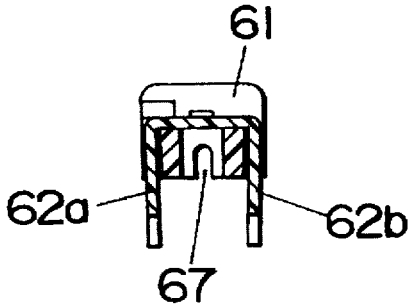
FIG. 9C is a cross-sectional view taken along the line V—V in FIG. 9B.

The first and second leads 62*a* and 62*b* respectively have a plurality of U-shaped bends 64*a* and 64*b*, each of which is formed between the adjacent contact holders 60 of the contact block 6, as shown in FIG. 9A. Each of the contact holders 60 has a concave 67 for receiving the projection 12 of the holder stand 11, which is formed in the bottom face of the contact holder, as shown in FIG. 9C. The contact block 6 is attached to the base 1 such that the projections 12 of the holder stands 11 arranged on the base in the column direction are inserted into the concaves 67 of the contact holders 60 of the contact block, each of the U-shaped bents 64*a* and 64*b* of the first and second leads 62*a* and 62*b* is fitted to a space between the adjacent holder stands 11, and the stationary contact terminals 65*a* and 65*b* are projected from the rear face of the base 1 through terminal holes 90, as shown in FIG. 11.

Figure 10A:
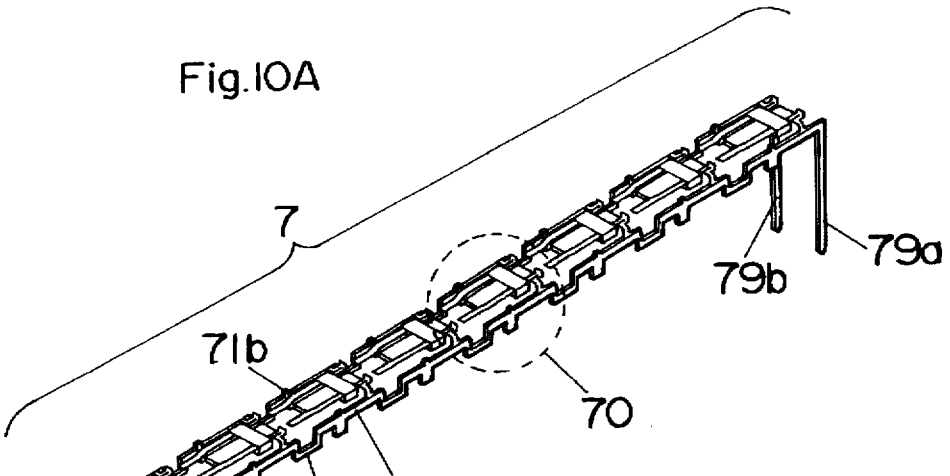
FIG. 10A is a perspective view of an armature block of the present matrix relay.
Figure 10B:
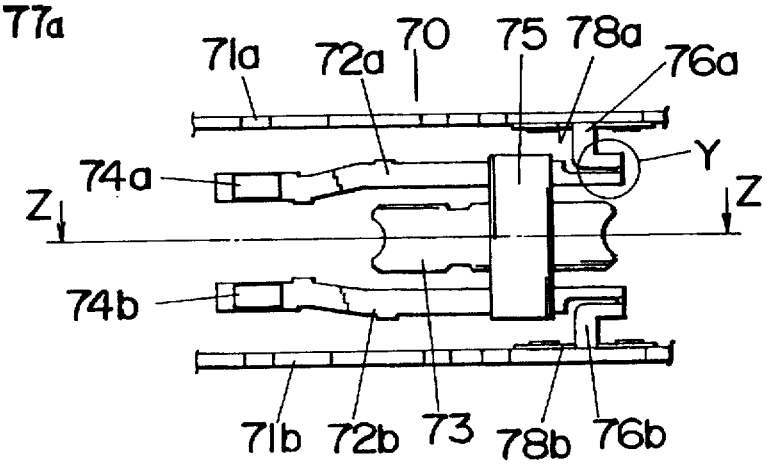
FIG. 10B is a bottom view of one armature unit of the armature block.

As shown in FIG. 10A, a plurality of the armature units 70 arranged in the row direction of the matrix is provided as a single armature block 7. As shown in FIG. 10B, each of the armature units 70 comprises an armature 73 made of a magnet material for receiving electromagnetic force developed by the excitation coil 50, a pair of first and second movable springs 72*a* and 72*b* which are disposed substantially parallel to each other at the both sides of the armature 73, and a connector 75 made of an electrically insulating resin for coupling between the armature and the movable springs. The armature units 70 of the armature block 7 are mechanically linked to a pair of first and second conductors 71*a* and 71*b* made of an electrically conductive material such that all of the first movable springs 72*a* and all of the second movable springs 72*b* of the armature units 70 are electrically connected to the first and second conductors 71*a* and 71*b*, respectively. Therefore, the first and second conductors 71*a* and 71*b* provides two row paths for electrical signals common to the latching relays arranged in the row of the matrix.

Figure 10C:
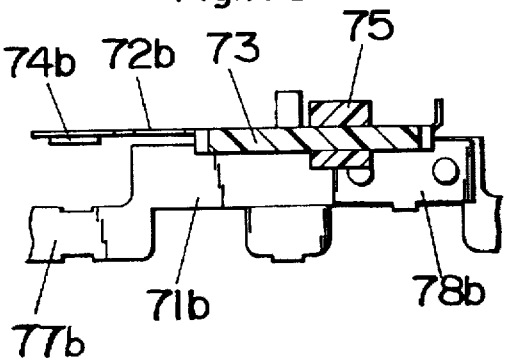
FIG. 10C is a cross-sectional view of the armature unit take along the line Z—Z in FIG. 10B.
Figure 10D:
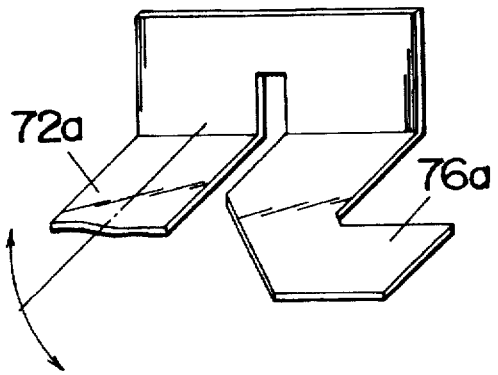
FIG. 10D is a perspective view of a region surrounded by the circle Y in FIG. 10B.

The first and second movable springs 72*a* and 72*b* has movable contacts 74*a* and 74*b* at their one ends, respectively. The first and second movable springs 72*a* and 72*b* are connected respectively to the first and second conductors 71*a* and 71*b* through supporting arms 76*a*, 76*b* and joints 78*a*, 78*b*, as shown in FIG. 10B. The supporting arm 76*a* and the joint 78*a* are integrally formed with the first movable spring 72*a* by bending the other end of the first movable spring in such a configuration that the first movable spring 72*a* can be supported in a cantilever fashion by the supporting arm 76*a*, as shown in FIG. 10D, and the joint 78*a* can be fixed to the first conductor 71*a* by staking, as shown in FIG. 10C. The staking means to join two parts together by fitting a projection on one part against a mating feature in the other part and then causing plastic flow at the joint portion. When the supporting arm 76*a* is stably fixed to the first conductor 71*a* through the joint 78*a*, the first movable spring 72*a* can be pivotally moved against the supporting arm 76*a* in directions shown by the arrows in FIG. 10D. The supporting arm 76*b* and joint 78*b* formed at the other end of the second movable spring 72*b* is identical in structure and function to those of the first movable spring 72*a*. The opposite ends of the first conductor 71*a* are bent substantially at right angles to form movable contact terminals 79*a*. Similarly, the opposite ends of the second conductor 71*b* are bent substantially at right angles to form movable contact terminals 79*b*.

Figure 2:
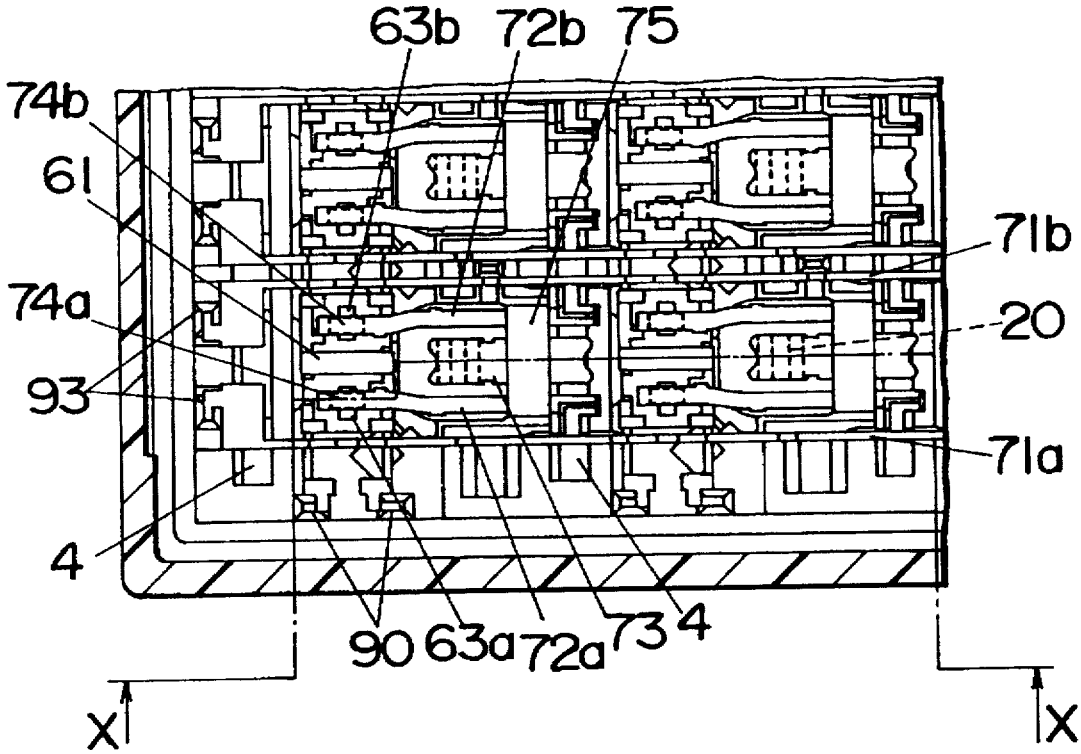
FIG. 2 is a top view of four latching relays at a corner of the matrix relay.

The armature block 7 is attached to the base 1 such that the first and second conductors 71*a*, 71*b* are inserted into the grooves 15 of the armature stands 14 arranged in the row direction, the movable contacts 74*a* and 74*b* are respectively disposed in a face-to-face relation with the stationary contacts 63*a* and 63*b*, as shown in FIG. 2, and the movable contact terminals 79*a* and 79*b* are projected from the rear face of the base 1 through terminal holes 93, as shown in FIG. 11. The first and second conductors 71*a* and 71*b* respectively have a plurality of U-shaped bents 77*a* and 77*b* formed between the adjacent armature units 70 of the armature block 7, which are utilized to adequately determine a distance between the movable and stationary contacts 74*a*, 74*b* and 63*a*, 63*b* when the armature block 7 is attached to the base 1.

As explained above, the matrix relay composed of sixty-four latching relays can be readily assembled by mounting the magnet blocks 4, shunt blocks 3, coil blocks 5, contact blocks 6, and the armature blocks 7 on the base 1 in which the core blocks 2 are embedded.

Next, an operation mechanism of each of the latching relays of the matrix relay is explained. As shown in FIGS. 2 and 3, the armature 73 is disposed directly above the iron core 20 to be movable in response to energization of the excitation coil 50 by current of selective polarity. The movement of the armature 73 is transmitted to the movable springs 72*a* and 72*b* through the connector 75, so that the movable springs can be moved between close and open positions of the movable and stationary contacts 74*a*, 74*b* and 63*a*, 63*b*.

For example, when a first current of a given polarity is supplied to the excitation coil 50, the armature 73 is moved to take the close position. On the other hand, when a second current of the opposite polarity is supplied to the excitation coil 50, the armature 73 is moved to take the open position. The permanent magnet 40 is magnetically coupled to the armature 73 to hold the armature in the closed position. That is, even when the supply of first current is stopped, the armature 73 can be stably held in the closed position by the formation of a closed magnetic circuit until the supply of the second current is started, to thereby achieve a latching performance of the relay. After the supply of the second current is stopped, the armature 73 can be held in the open position by spring forces of the movable springs 72*a*, 72*b* until the supply of the first current is started.

Figure 7:
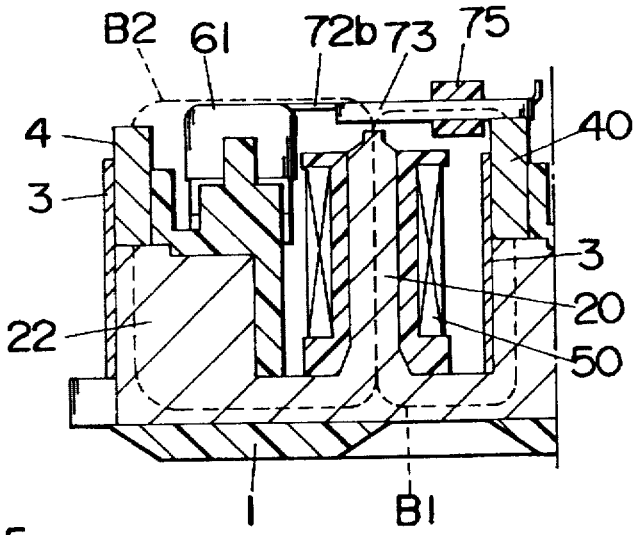
FIG. 7 is a schematic diagram understanding magnet flux of a permanent magnet in the latching relay.

As shown in FIG. 7, magnetic flux B1 of the permanent magnet 40 of each of the latching relays is cooperative with magnetic flux B2 of the permanent magnet of the adjacent latching relay in the row direction to achieve the latching performance of the relay. In the present matrix relay, since the magnet block 4 is also mounted on the shoulder portions 23 of the core teeth 22 projected from the additional partition 13, the cooperative magnetic flux can be given to the latching relays arranged adjacent to the additional partition 13. As a result, it is possible to provide uniform latching performance to the individual latching relays of the matrix relay.

Figure 12:
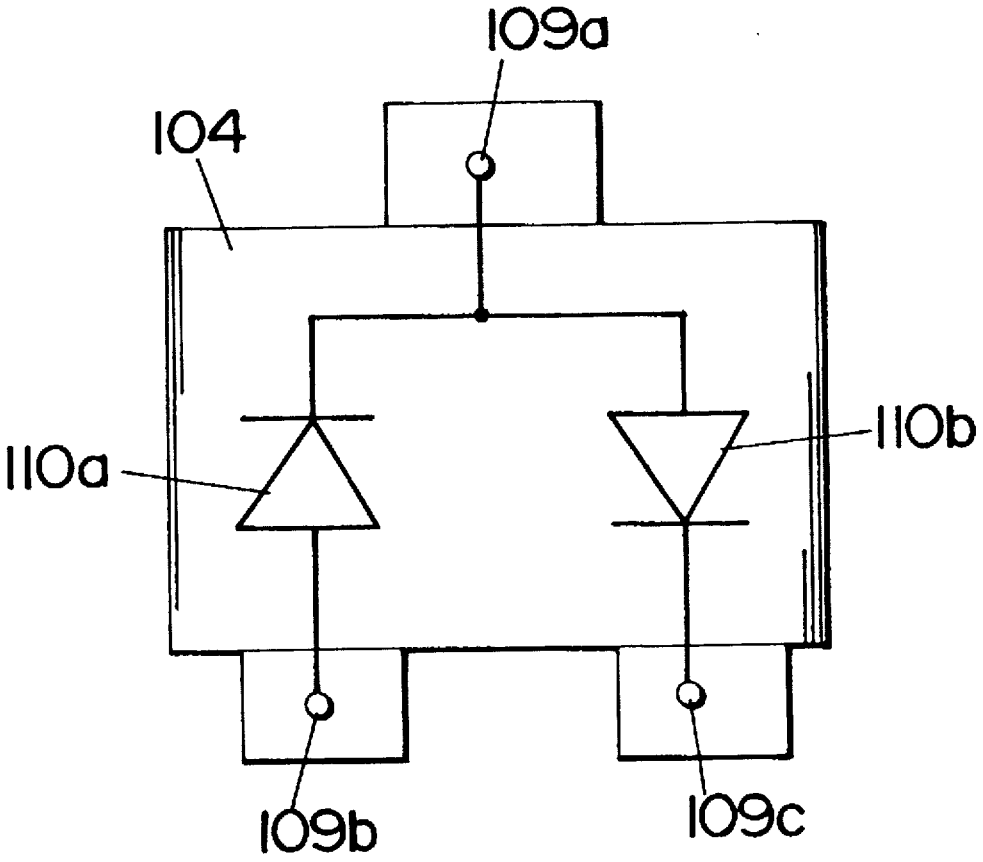
FIG. 12 is a diagram illustrating a diode circuit of the matrix relay.

The present matrix relay further comprises a plurality of diode circuits 104 to be mounted on the rear face of the base 1. That is, after sixty-four latching relays are assembled on the base 1, the diode circuit is attached to each of the latching relays. As shown in FIG. 12, the diode circuit 104 is composed of two diodes 110*a* and 110*b* connected in series to define a common terminal 109*a* between the diodes, a first terminal 109*b* at opposite end of the diode 110*a* from the common terminal 109*a*, and a second terminal 109*c* at opposite end of the diode 110*b* from the common terminal. The common terminal 109*a* is connected to the second coil terminal 57 of the excitation coil 50. All of the first terminals 109*b* and all of the second terminals 109*c* of the diode circuits 104, which are associated with the latching relays arranged in the row of the matrix, are connected respectively to a pair of diode terminals through two lead wires, for example, as shown by the numerals 108$_1$ and 108$_2$ in FIG. 13. As a result, the lead wires provide two current paths common to the diode circuits associated with the latching relays arranged in the row.

Figure 15A:
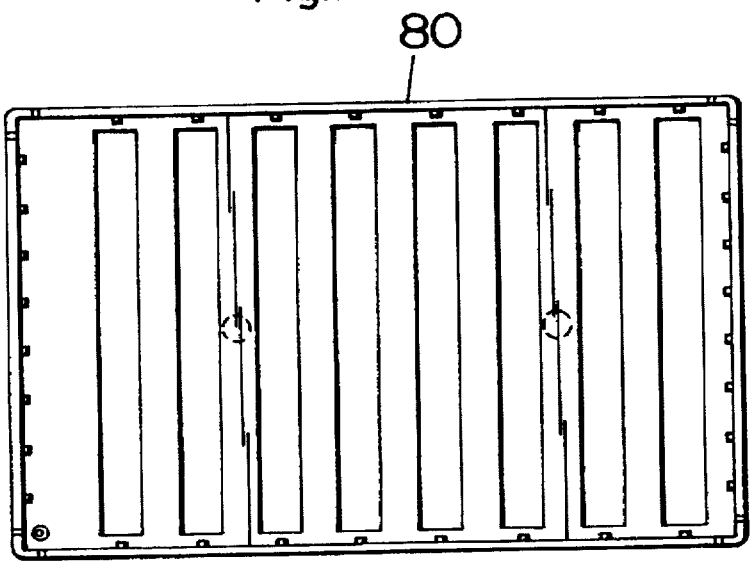
FIG. 15A is a plan view of a cover of the matrix relay.
Figure 15C:
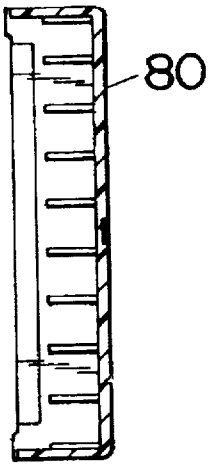
FIGS. 15B and 15C are cross-sectional views of the cover.
Figure 15B:
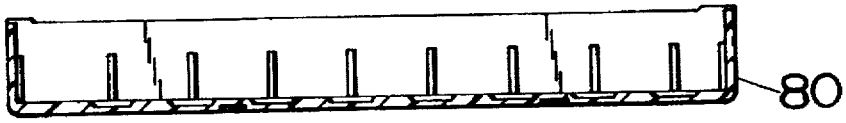

Finally, a cover 80, which is shown in FIGS. 15 A to 15C, is attached to finish the matrix relay.

Figure 13:
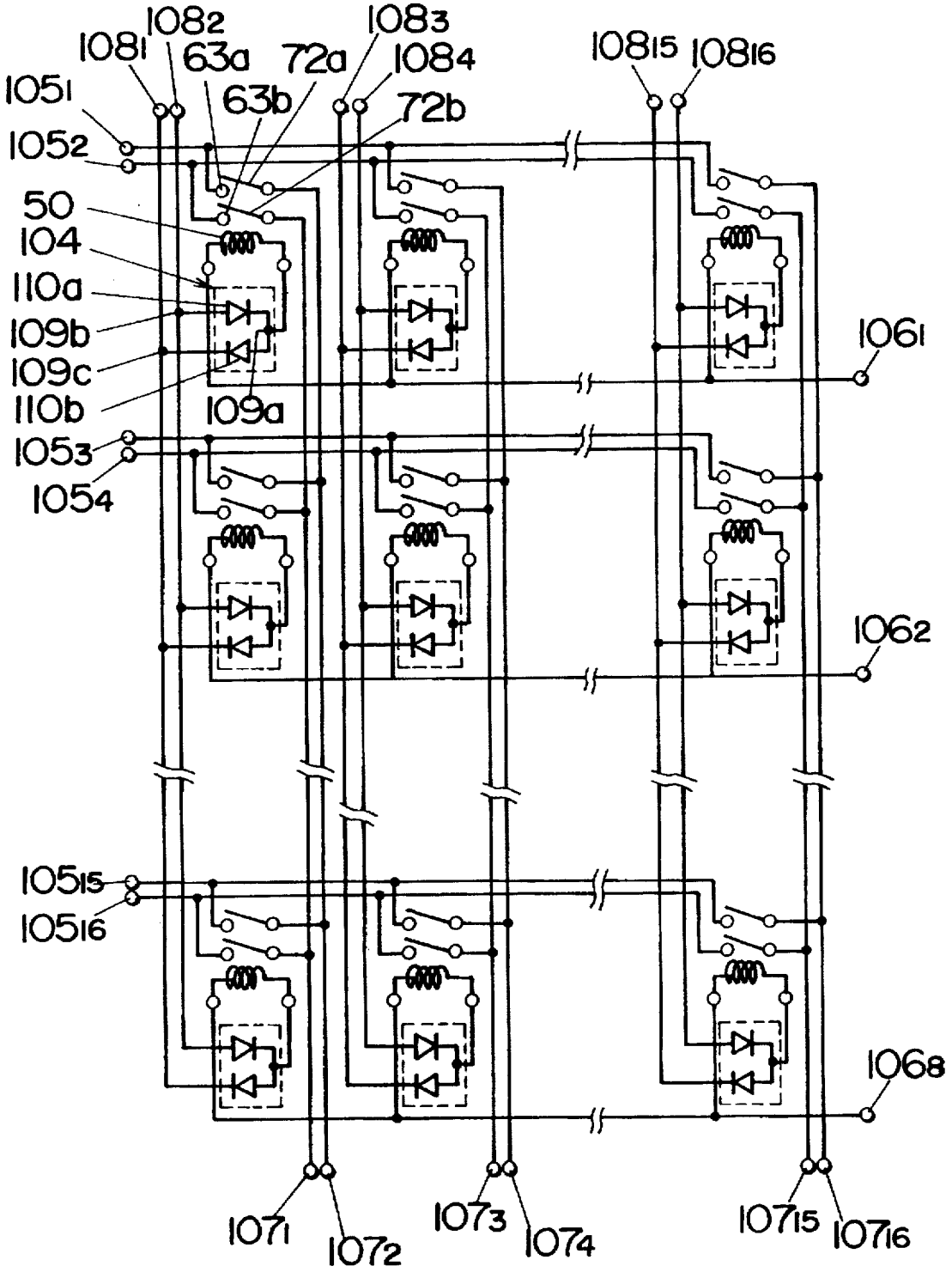
FIG. 13 is a circuit diagram of the matrix relay.

The present matrix relay is operated in accordance with the following principle. In FIG. 13, eight pairs of diode terminals, each pair of which is connected to the diode circuits 104 of the latching relays arranged in a row of the matrix through two lead wires, are designated by the numerals 108$_1$ to 108$_{16}$. For example, one pair of ends of the lead wires are connected to the pair of the diode terminals 108$_1$ and 108$_2$. The other pair of ends of the lead wires are connected to the diode circuit 104 of the outermost one of the latching relays arranged in the row. Eight pairs of the movable contact terminals, each pair of which is connected respectively to the movable contacts 74*a* and 74*b* of the latching relays arranged in the row through the first and second conductors 71*a* and 71*b*, are designated by the numerals 107$_1$ and 107$_{16}$. Eight pairs of the stationary contact terminals, each pair of which is connected respectively to the stationary contacts 63*a* and 63*b* of the latching relays arranged in the column through the first and second leads 62*a* and 62*b*, are designated by the numerals 105$_1$ and 105$_{16}$. Eight coil terminals, each of which is connected to the excitation coils 50 of the latching relays arranged in the column through the first lead members 54*a*, are designated by the numerals 106$_1$ and 106$_8$.

In an initial state, the armatures of all the latching relays are held in the open position between the movable and stationary contacts. For example, when the diode terminal 108$_2$ is positively charged by a power source (not shown), and the coil terminal 106$_1$ is electrically grounded, a first current flows from the diode terminal 108$_2$ to the coil terminal 106$_1$ through the diode 110*a* and excitation coil 50, so that the armature 73 receives electromagnetic force developed by the excitation coil 50 to allow the movable springs 72*a* and 72*b* to make the closed position between the movable and stationary contacts 74*a*, 74*b* and 63*a*, 63*b*. As a result, the movable contact terminals 107$_1$ and 107$_2$ are respectively connected to the stationary contact terminals 105$_1$ and 105$_2$. Even after the diode terminal 108$_2$ and the coil terminal 106$_1$ are separated respectively from the power source and the ground, the movable springs 72*a* and 72*b* are held in the close position by magnetic force provided from the permanent magnets 40.

Next, when the when the diode terminal 108$_1$ is negatively charged by the power source, and the coil terminal 106$_1$ is electrically grounded, a second current flows from the coil terminal 106$_1$ to the diode terminal 108$_1$ through the excitation coil 50 and the diode 110*b*, so that the armature 73 receives electromagnetic force developed by the excitation coil 50 to allow the movable springs 72*a* and 72*b* to make the open position between the movable and stationary contacts. As a result, the movable contact terminals 107$_1$ and 107$_2$ are respectively disconnected from the stationary contact terminals 105$_1$ and 105$_2$. Even after the diode terminal 108$_1$ and the coil terminal 106$_1$ are separated respectively from the power source and the ground, the movable springs 72*a* and 72*b* are held in the open position by the spring force thereof.

Thus, in the present matrix relay, when voltage feed is performed to one of the eight pairs of the diode terminals $108_1$ to $108_{16}$ which is connected to the diode circuit of a latching relay to be operated, and one of the coil terminals $106_1$ to $106_8$ which is connected to the excitation coil of the latching relay to be operated is electrically grounded, a desired pair of the eight pairs of the movable contact terminals $107_1$ and $107_{16}$ can be connected or disconnected to a desired pair of the eight pairs of the stationary contact terminals $105_1$ and $105_{16}$.

As the most simple method of operating a matrix relay in which latching relays are arranged in a matrix (N×N), it would be readily proposed to wire feed lines to individual excitation coils of the latching relays to energize the excitation coils. Therefore, the feed lines of $2\times N\times N$ ($=2N^2$) are required for the matrix relay. Such a large number of the feed lines will bring complicated fabrication process of the matrix relay. In the present invention, due to the structural advantage of the coil block and the use of two lead wires for connecting the diode terminals to the diode circuits of the latching relays arranged in each row, the matrix relay can be operated by reduced feed lines 3N, i.e., N (the number of the coil terminals)+2N (the number of the diode terminals). By this simplification of electric circuits, the matrix relay of the present invention can be readily fabricated, and particularly, is suited to a small-size the matrix relay.

Figure 14:
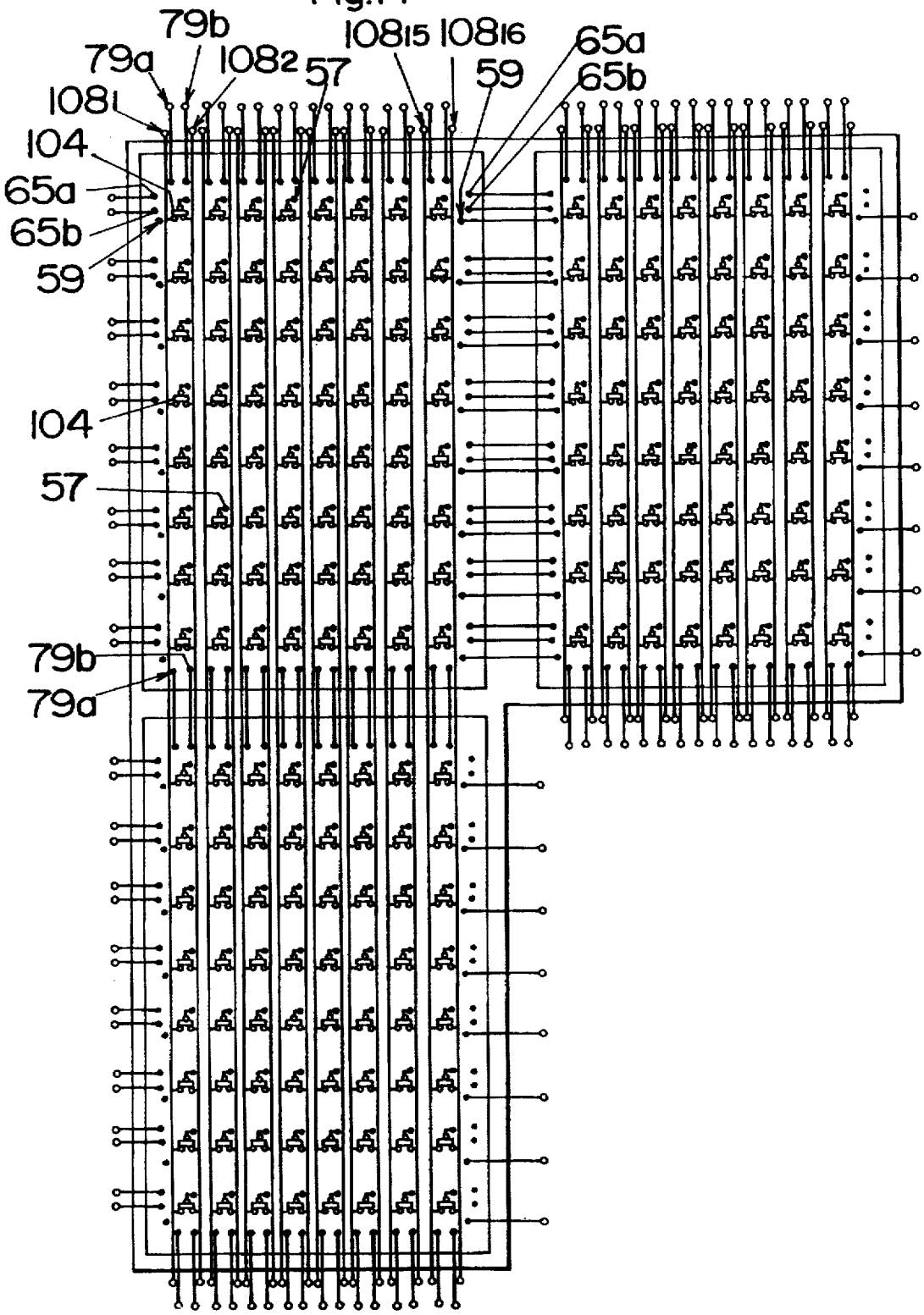
FIG. 14 shows a wiring pattern between adjacent matrix relays in column and row directions; and In FIGS. 15A to 15C.

As a modification of this embodiment, in case of using a plurality of the above-explained matrix relays to form a collective matrix relay, wiring patterns between adjacent matrix relays in a column direction and between adjacent matrix relays in a row direction are illustrated in FIG. 14.

What is claimed is:

1. A matrix relay comprising:

a base of an electrically insulative material;

a plurality of latching relays which are arranged in a matrix and mounted on said base;

each of said latching relays comprising:

an excitation coil having first and second ends;

a permanent magnet for providing a latching force;

a pair of first and second fixed contacts; and an armature carrying a pair of first and second movable springs each providing movable contacts, said armature being magnetically coupled to said excitation coil, said armature being movable in response to energization of said coil by current of selective polarity between closed and open positions of said fixed and movable contacts;

wherein a plurality of said armatures of said latching relays arranged in a row of said matrix are assembled into a single armature block to be mounted on said base as a single unit, and wherein said armature block comprises:

a single pair of first and second rigid supporting members made of an electrically conductive material, all said first movable springs and all said second movable springs of the armatures of said armature block being connected respectively to said first and second rigid supporting members mechanically and electrically, thereby providing two row paths for electrical signals common to the latching relays arranged in the row of said matrix.

2. A matrix relay as set forth in claim 1, wherein said excitation coil is fitted around a coil bobbin, said coil bobbin having a bore which receives one of cores projecting on said base and arranged in the matrix, and wherein said cores arranged along the row of said matrix are formed as integral parts of a single yoke which is molded into said base to project said cores on said base.

3. A matrix relay as set forth in claim 1, wherein all said first ends of said excitation coils of said latching relays arranged along a column of said matrix are connected electrically and mechanically to a common conductor so that said excitation coils arranged along the column are assembled into a single coil block to be mounted on said base as a single unit.

4. A matrix relay as set forth in claim 1, wherein each of said latching relays includes a contact holder which is made of an electrically insulative material and supports said first and second fixed contacts, and wherein a plurality of said contact holders of said latching relays arranged in a column of said matrix are assembled into a single contact block to be mounted on said base as a single unit, and wherein said contact block comprises:

a single pair of first and second lead members of an electrically conductive material, all said first fixed contacts and all said second fixed contacts of the contact holders of said contact block being connected respectively to said first and second lead members mechanically and electrically, whereby providing two column paths for electrical signals common to the latching relays arranged in the column of said matrix.

5. A matrix relay as set forth in claim 1, wherein said permanent magnets are mounted on said base in such an arrangement that a magnetic force of said permanent magnet of each said latching relay are cooperative with that of adjacent latching relay in the row of said matrix to hold said armature in the close position.

6. A matrix relay as set forth in claim 5, wherein an additional permanent magnet is mounted on said base outwardly of the outermost one of said latching relays arranged in the row of said matrix so as to be cooperative with said permanent magnet of the outermost latching relay to give a magnetic force of holding said armature in the close position.

7. A matrix relay as set forth in claim 1, wherein a plurality of diode circuits are connected to said excitation coils, respectively, each of said diode circuits comprising a pair of diodes connected in series to define a common terminal between said diodes, a first terminal at opposite end of one of said diodes from said common terminal, and a second terminal at opposite end of the other diode from said common terminal, said common terminal of each said diode circuit being connected to said second end of each said excitation coil, and wherein all said first terminals and all said second terminals of said diode circuits associated with the latching relays arranged in the row of said matrix are connected respectively to a single pair of first and second lead wires, whereby providing two current paths common to said diode circuits associated with the latching relays arranged in the row.

8. A matrix relay as set forth in claim 1, wherein said first and second movable springs are supported to said first and second supporting members through joints in a cantilever fashion such that said first and second supporting members are electrically connected to the movable contacts on said first and second movable springs, respectively.

9. A matrix relay as set forth in claim 8, wherein said joints are formed as integral parts of said first and second movable springs, respectively.

10. A matrix relay as set forth in claim 1, wherein said plurality of said armatures are mechanically connected to form a single armature block only by said first and second rigid supporting members.

11. A matrix relay as set forth in claim 1, wherein a mechanical connection of said plurality of said armatures consists essentially of said first and second rigid supporting members.

12. A matrix relay as set forth in claim 1, wherein each of said first and second rigid supporting members is formed with a horizontal portion extending along the row of said matrix and perpendicular portions at opposite ends, substantially perpendicular to said horizontal portion, and wherein said perpendicular portions project from a bottom surface of said base when said armature block is mounted on said base.

13. A matrix relay as set forth in claim 3, wherein said common conductor is formed with a horizontal portion extending along the column of said matrix and perpendicular portions at opposite ends, substantially perpendicular to said horizontal portion, and wherein said perpendicular portions project from a bottom surface of said base when said coil block is mounted on said base.

14. A matrix relay as set forth in claim 4, wherein each of said first and second lead members is formed with a horizontal portion extending along the column of said matrix and perpendicular portions at opposite ends, substantially perpendicular to said horizontal portion, and wherein said perpendicular portions project from a bottom surface of said base when said contact block is mounted on said base.

* * * * *